US005486149A

United States Patent [19]

Smith et al.

[11] Patent Number: 5,486,149

[45] Date of Patent: Jan. 23, 1996

[54] FRICTION RESISTANCE EXERCISE DEVICE

[75] Inventors: Fred T. Smith; Fred P. Smith, both of Alpine, Utah

[73] Assignee: F. S. New Products, Inc., Alpine, Utah

[21] Appl. No.: 246,310

[22] Filed: May 19, 1994

Related U.S. Application Data

[63] Continuation of Ser. No. 21,186, Feb. 22, 1993, abandoned.

[51] Int. Cl.[6] ..... A63B 21/018

[52] U.S. Cl. ..... 482/120; 482/127; 482/129; 482/904

[58] Field of Search ..... 482/114, 115, 482/116, 118, 120, 127, 129, 904; 182/234, 232, 231; 188/264 R, 264 A, 264 W

[56] References Cited

U.S. PATENT DOCUMENTS

| | | | |
|---|---|---|---|
| 2,740,502 | 4/1956 | Butterfield | 188/264 R |
| 4,174,832 | 11/1979 | Thompson | 482/120 |
| 5,147,264 | 9/1992 | Braathen | 482/120 |

*Primary Examiner*—Lynne A. Reichard
*Attorney, Agent, or Firm*—Ellsworth R. Roston; Charles H. Schwartz

[57] ABSTRACT

A one way clutch is rotatable with a member (e.g. helical spring) and a sleeve while the spring is being constrained by the manual winding of a cable on the sleeve. The sleeve is constructed to wind the cable uniformly on the sleeve. During the constraint imposition, the clutch drives a shaft and a disc. One disc surface abuts bearing liners affixed to a casing. The other disc surface is separated from the spring. Calibrated numbers are printed on the casing periphery. A dial externally supported by, the casing is rotatable relative to the casing to any of the calibrated numbers to adjust the friction force between the liners and the disc when the disc is rotated. The casing is vented at its opposite ends. When the spring is being constrained or the constraint is being released, air flows through the vents and through the space between the successive turns in the spring and past the disc to cool the disc. When the spring constraint is released, the clutch floats relative to the shaft so that the spring returns to its unconstrained relationship without any movement of the shaft or the disc. The dial is also adjustable in position, independently of any dial rotation, after being removed from the casing to adjust the calibration of the friction force between the liner and the disc and is thereafter attached to the casing in this adjusted position. Another looped cable anchors the exercise apparatus against a post before the apparatus is operated.

49 Claims, 3 Drawing Sheets

FIG. 1
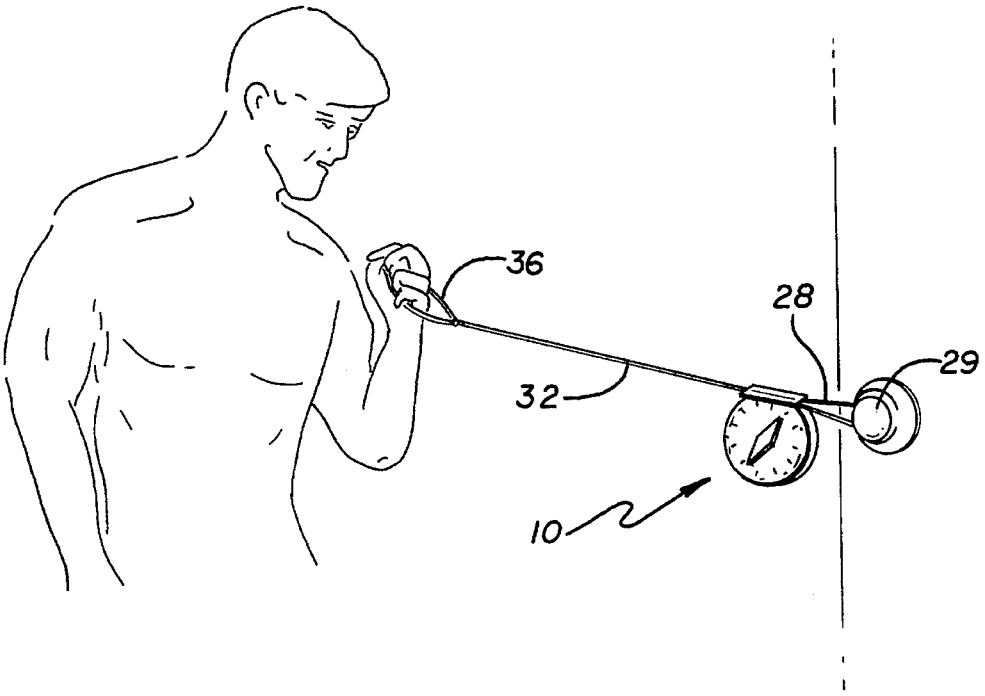
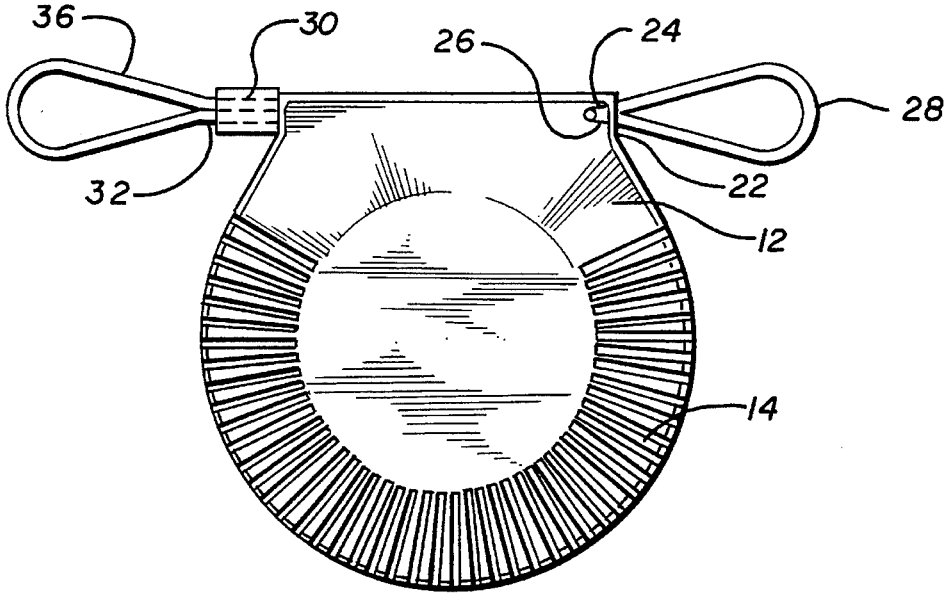
FIG. 2

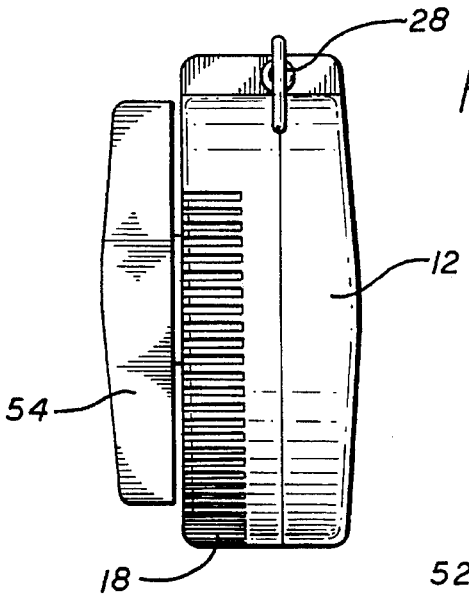
FIG. 3
FIG. 4
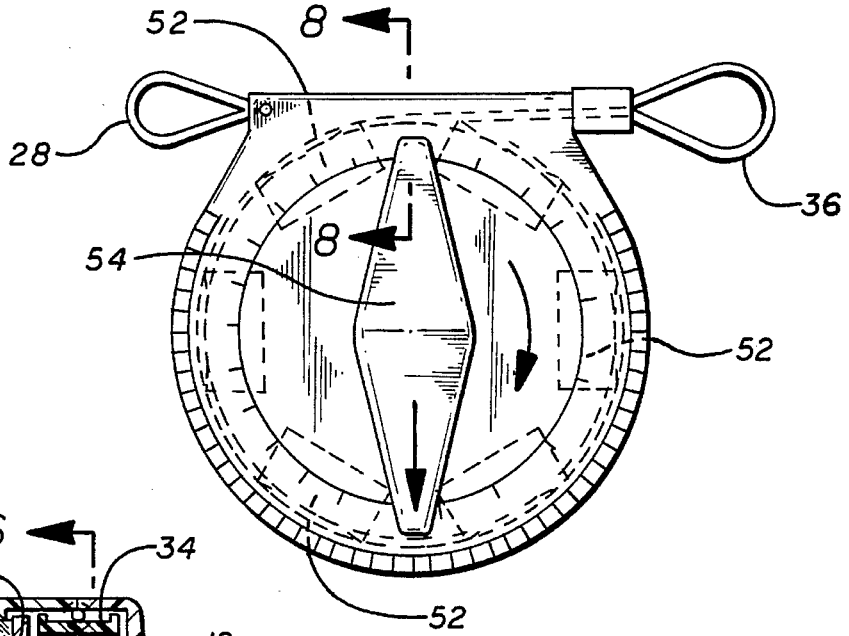
FIG. 5
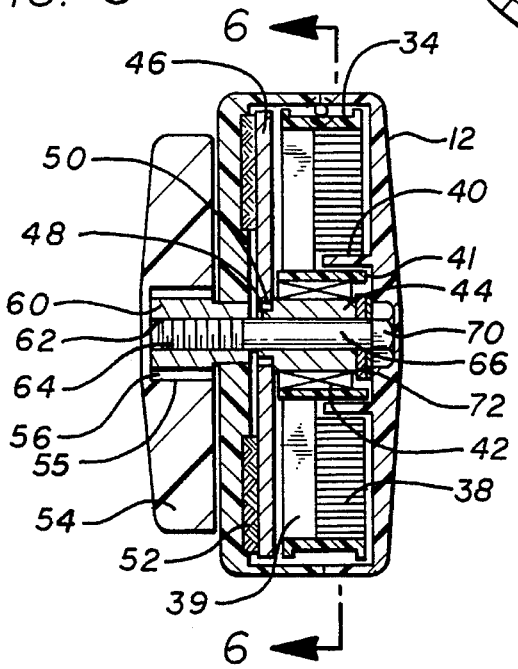
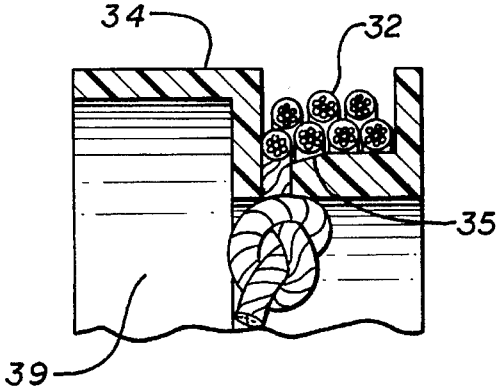
FIG. 8

FIG. 7
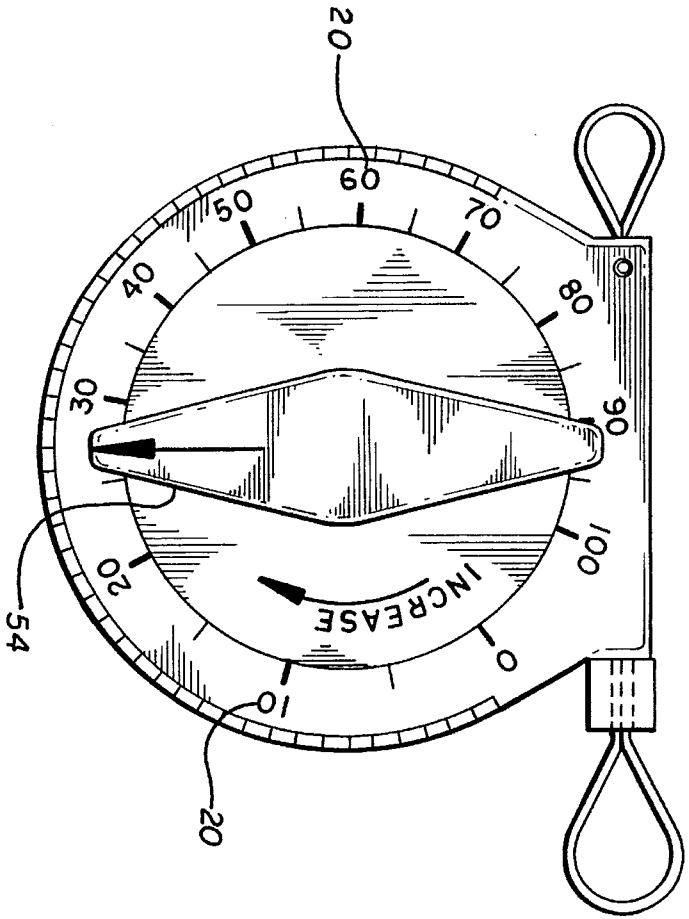
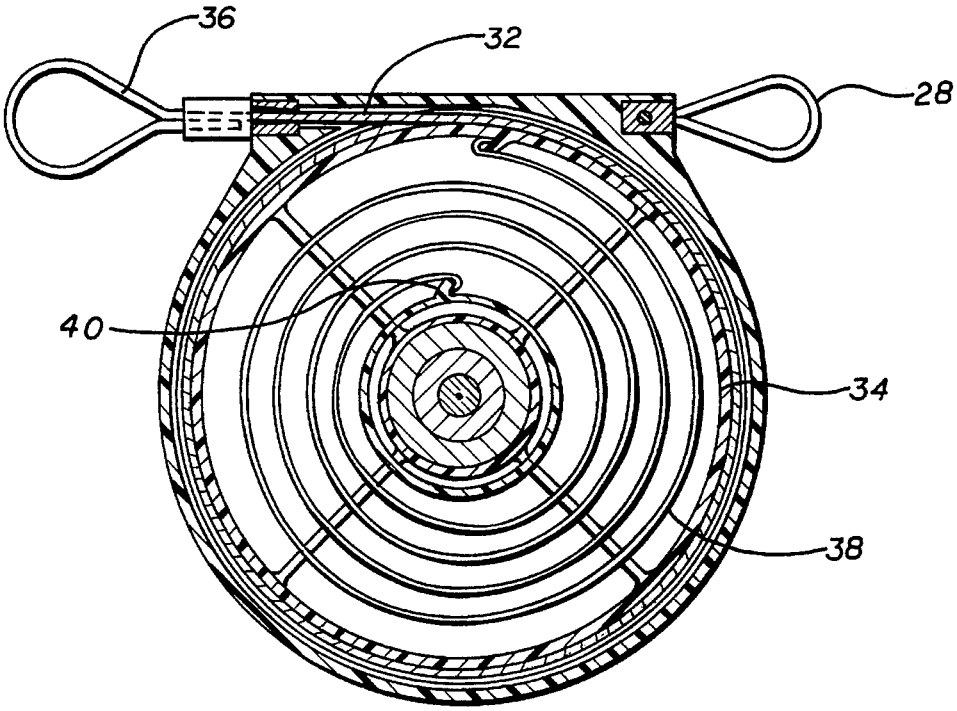
FIG. 6

FRICTION RESISTANCE EXERCISE DEVICE

This is a continuation of application Ser. No. 08/021,186, filed Feb. 22, 1993 now abandoned.

This invention relates to exercise apparatus. More particularly, the invention relates to exercise apparatus which is light in weight and compact so as to be easily portable in a traveller's suitcase and which produces an adjustable resistance force to provide for a wide range of different exercises.

In the past few decades, the public has become conscious of physical fitness. Because of this, many homes have special rooms in which large, expensive and cumbersome machines are stored to provide the residents an opportunity to exercise on a scheduled basis. Aficionados even carry exercise apparatus with them on trips even though such apparatus is large, expensive and cumbersome. In view of the interest exhibited by a large proportion of the public in exercise apparatus, a considerable amount of effort has been made, and a significant amount of money has been expended, to develop apparatus which is light in weight, compact and easily portable and which has a wide range of applications. In spite of such effort and such expenditure of moneys, exercise apparatus meeting the criteria specified above does not exist.

Different types of apparatus do exist but each type has inherent limitations. For example, exercise machines have used weights to provide a resistance. An example is a universal weight machine. A disadvantage of such apparatus is that they are heavy and bulky and cannot be easily stored. Another type of exercise apparatus has employed springs. These generally have a set resistance which cannot be changed. Such apparatus accordingly has a limited range of uses.

Machines have also been used in the prior art which employ isometric principles. In this type of machine, the user provides the resistance. These machines are disadvantageous in that they provide only a limited range of utility.

Machines employing shock absorption have also been used in the prior art. In this type of machine, the resistance is varied by changing the moment arm of the shock. This is accomplished by providing a plurality of holes and by changing the magnitude of the shock by physically changing the magnitude of the shock from one hole to another. Thus, the resistance variation is stepped. These machines are also disadvantageous in that they are bulky and in that the resistances are not uniform during operation. This results from the fact that the resistances vary because the shock is attached to a link and the link swings through an arc.

In one embodiment of the invention, a one way clutch is rotatable with a member (e.g. a helical spring) and a sleeve while the spring is being constrained by the manual winding of a cable on the sleeve. The sleeve is constructed to wind the cable uniformly on the sleeve. During the constraint imposition, the clutch drives a shaft and a disc. One surface of the disc abuts bearing liners which are affixed to a casing. The other disc surface is separated from the spring.

Calibrated numbers are printed on the casing periphery. A dial externally supported by the casing is rotatable relative to the casing to any of the calibrated numbers to adjust the friction force between the liners and the disc when the disc is rotated. The casing is vented at its opposite ends. When the spring is being constrained or the constraint is being released, air flows through the vents and through the space between the successive turns in the spring and past the disc to cool the disc. When the spring constraint is released, the clutch floats relative to the shaft so that the spring returns to its unconstrained relationship without any movement of the shaft or the disc. The dial is also adjustable in position, independently of any dial rotation, after being removed from the casing so as to adjust the calibration of the friction force between the liner and the disc. Another looped cable anchors the exercise apparatus against a post before the apparatus is operated.

In the drawings:

FIG. 1 is a schematic view of exercise apparatus constituting one embodiment of the invention and a person using the apparatus;

FIG. 2 is an enlarged rear elevational view of the exercise apparatus shown in FIG. 1;

FIG. 3 is an enlarged side elevational view of the exercise apparatus;

FIG. 4 is an enlarged schematic front elevational view of the exercise apparatus and schematically illustrates certain features of the apparatus;

FIG. 5 is a sectional view in side elevation of the apparatus;

FIG. 6 is a sectional view in elevation of the apparatus and is taken substantially on the line 6—6 of FIG. 5 illustrates certain features on the front face of the apparatus;

FIG. 7 is a front elevational view of the exercise apparatus and illustrates a dial and calibrations on this face; and FIG. 8 is a fragmentary sectional view of the exercise apparatus and illustrates the construction of a sleeve for winding a cable uniformly on the sleeve.

In one embodiment of the invention, exercise apparatus generally indicated at 10 is provided. The exercise apparatus 10 includes a casing 12 which may be made from a plastic material or a metal such as aluminum and which may be provided with a generally cylindrical configuration. The casing 12 may be vented as at 14 (FIG. 2) around its periphery at one axial side of the cylindrical configuration and may be vented as at 18 (FIG. 3) around its periphery at the other axial side of the cylindrical configuration. One annular face of the casing 12 may be provided with progressive annular numbers 20 (FIG. 7) around its annular periphery. The numbers 20 indicate the frictional force provided in the exercise apparatus 10 when the apparatus is operated.

The casing 12 is provided with an extension 22 at one annular end. A hole (not shown) is provided in the extension 22 at one end and a cable 26 is extended through the hole and is attached to a detent 24 in the casing at one end. At its other end, the cable is looped as at 28. The loop 28 may be disposed around restraining means such as a post 29 (FIG. 1) to provide a fixed support for the exercise apparatus 10. A hole 30 (FIGS. 2 and 6) may also be provided in the extension 22 at the other end and a cable 32 may be extended through the hole 30 at one end and attached to a sleeve 34. The sleeve 34 is provided with a bevelled periphery 35 (FIG. 8) to assure that the cable 32 is uniformly wound on the sleeve periphery and is uniformly unwound from the spring periphery. At its other end, the cable 32 may be provided with a looped configuration as at 36 so that an individual's hand or foot may be extended through the loop to actuate the cable and constrain a constrainable member such as a helical spring 38 in the casing 12.

Fan blades 39 are attached to the sleeve 34 and the constrainable member such as the helical spring 38 is also attached at one end to the sleeve 34. The other end of the helical spring 38 is attached to a finger 40 (FIG. 5) which extends inwardly from the casing 12. The fan blades 39 are attached at their inner ends to a collar 41 and the collar 41 is in turn attached to a one-way clutch 42 which may be constructed in a manner well known in the art. The one-way clutch 42 is disposed on a bearing 44 and is constructed to drive the bearing 42 during the rotation of the one-way clutch 44 in one direction and to rotate freely on the bearing during the rotation of the clutch in the opposite direction.

The bearing 44 is in turn affixed to a disc 46 which may be made from a suitable material such as a stainless steel. The fixed coupling between the bearing 44 and the disc 46 may be provided as by teeth 48 on the periphery of the bearing and teeth 50 on the periphery of the disc. The disc 46 is preferably spaced axially from the helical spring 38.

A plurality of bearing liners or friction pads 52 (FIG. 4) are disposed on the opposite surface of the disc 46 from the helical spring 38 to provide a frictional force against the disc when the disc is rotated. The bearing liners 52 are preferably disposed in spaced positions around the annular periphery of the disc. The bearing liners 52 are in turn affixed to the casing 12 at the surface opposite the surface abutting the disc.

A dial 54 (FIGS. 3, 4 and 7) is disposed externally in contiguous relationship to the casing face having the calibration numbers 20. The dial 54 has an annular opening 55 (FIG. 5) at its inner radial end. Teeth 56 are disposed around the annular opening 54. The teeth 56 mesh with teeth on the outer periphery of a collar 60. The collar 60 is provided with a threaded opening 62 which meshes with the threaded periphery 64 of a shaft 66. The shaft 66 extends through an opening in the bearing 44 to the opposite surface of the casing 12. The shaft 66 has a head 70 at this opposite end and the head abuts a flange 72 on the bearing 44.

When an individual desires to use the exercise apparatus 10, such individual disposes the loop 28 around the post 29 (FIG. 1) and disposes his or her hand or foot in the loop 36 in the cable 32. The individual then pulls the cable 32 outwardly from the casing. This causes the fan blades 39 to rotate and the helical spring 38 to become constrained. The one-way clutch 42 rotates with the fan blades 39 and drives the disc 46 against the friction force imposed by the bearing liners 52. The force imposed by the bearing liners 52 against the disc 46 remains substantially constant throughout the rotation of the disc. When the cable 32 is released, the constraint of the spring 38 produces a rotation of the one-way clutch 42 and the fan blades 39 and the sleeve 34 in a direction to release the constraint on the spring. However, the clutch 42 is decoupled from the bearing 44 so that the bearing and the disc 46 do not rotate. The cable 32 becomes wound uniformly on the periphery of the sleeve 34 as the sleeve rotates, as indicated schematically in FIG. 8. Successive loops of the cable occur on the periphery of the sleeve 34 from the lowermost end of the sleeve periphery. Successive loops are then provided in a successive layer in the space between successive pairs of the first loops.

As the fan blades 39 rotate, they draw air through one set of the vents 14 and 18. The fan blades 39 then drive the air through a path including the space between the successive turns in the helical spring 38 and the space between the fan blades and the disc 46. This flow of air cools the disc 46 and removes the heat generated by the friction resulting from the rotation of the annular surface of the disc against the bearing liners 52. The air moves in one direction past the disc 46 during the rotation of the fan blades 39 in one direction and moves in the opposite direction during the rotation of the fan blades 39 in the opposite direction.

The magnitude of the friction force imposed by the bearing liners 52 against the disc 46 during the rotation of the disc may be adjusted by rotating the dial 54 (FIGS. 3, 4 and 7). This rotation causes the shaft 66 to rotate so as to vary the force imposed by the head 70 on the shaft against the flange 72 on the bearing 44. Since the bearing 44 is coupled to the disc 46, the force exerted by the disc against the bearing liners 52 is correspondingly varied.

As the exercise apparatus 10 continues to be operated, the bearing liners 52 may become flattened or worn. The calibration of the friction force exerted by the bearing liners 52 on the disc 46 may accordingly be adjusted by removing the dial 54 from the collar 60, rotating the dial slightly and then inserting the dial again on the collar.

The exercise apparatus described above has certain important advantages. It is light in weight, its weight being less than two pounds (2 lbs.). It is quite compact so that it can be easily inserted into a user's suitcase or briefcase. It provides a substantially constant force throughout the actuation of the cable 32. This force can be accurately calibrated. Furthermore, the force can be adjusted by rotating the dial 54. In case the force has to be recalibrated after use, the dial 54 can be removed from the sleeve, rotated and then reinserted on the sleeve.

The exercise apparatus 10 is also advantageous in providing a cooling action on the disc 46 every time that the disc is rotated. Furthermore, the casing 12 remains cool because of the heat barrier provided by the bearing liners 52. The exercise apparatus 10 is further advantageous in that the cable 32 becomes uniformly wound on the periphery of the sleeve 34.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination for use in exercise apparatus attachable to restraining means, a rotatable disc having a first surface, at least one brake liner having first and second surfaces and having its first surface disposed in frictional relationship to the first surface of the disc, a rotatable sleeve having an annular configuration, a constrainable spring operatively coupled to the sleeve for imposition of a constraint on the spring, and a release of the constraint on the spring, in accordance with the rotation of the sleeve, a first cable movable in first and second opposite directions and operatively coupled to the sleeve for constraining the spring upon a movement of the cable in the first direction, first means operatively coupled to the sleeve and the disc during the movement of the cable in the first direction for moving the disc in accordance with the movement of the sleeve, and second means for providing a release of the constraint on the spring, without moving the disc, upon the release of the first cable, a casing enveloping the rotatable disc, the brake liner, the constrainable spring, the first means and the second means, a second cable attached at one end to the casing for the imposition of a constraining force in a first direction substantially tangential to the annular periphery of a sleeve and constructed at the second end for coupling to the restraining means, and the first cable extending through the casing for operative coupling to the sleeve and for the imposition of a force on the sleeve in a second direction tangential to the annular periphery of the sleeve but opposite to the first tangential direction.

2. In a combination as set forth in claim 1, the casing having vents at the opposite axial ends of the casing, and means including the vents at the opposite ends of the casing for cooling the disc during the constraint and the release of the constraint of the spring.

3. In a combination as set forth in claim 1, third means for adjustably setting the force required to constrain the spring in accordance with the movements of the cable in the first tangential direction, the casing having an extension at one end, the first and second cables extending from the extension of the casing in opposite directions substantially tangential to the periphery of the sleeve.

4. In a combination as set forth in claim 1, third means for cooling the disc during the constraint, and the release of the constraint, of the spring, the third means including vents at the opposite axial ends of the casing.

5. In a combination as set forth in claim 1, the rotatable sleeve having a peripheral surface constructed to provide a substantially uniform winding of the cable on the sleeve periphery in a plurality of loops with individual ones of the successively wound loops being disposed on successive pairs of the previously wound loops in the space between such pairs of the previously wound loops and alternately a substantially uniform unwinding of the cable from the sleeve periphery.

6. In combination for use in exercise apparatus, a casing having first and second opposite ends displaced from each other in an axial direction, there being vents in the first and second opposite ends of the casing, a disc rotatable on an axis extending in the axial direction and having first and second opposite sides displaced from each other in the axial direction, at least one brake liner having first and second opposite sides and disposed with the first side abutting the first side of the disc and with the second side abutting the first side of the casing, constrainable means disposed on the second side of the disc, there being a spacing in the axial direction between the disc and the constrainable means on the second side of the disc to provide for a cooling of the disc through such spacing and through the constrainable means and the vents, means for providing a coupling between the disc and the constrainable means during the constraint of the constrainable means to obtain a rotation of the disc in the first direction against the frictional force exerted by the at least one brake liner, and means for decoupling the disc and the constrainable means during the release of the constraint on the constrainable means to provide for a release of the constraint on the constrainable means without any movement of the disc.

7. In a combination as set forth in claim 6, a cable extending through the casing in a direction substantially perpendicular to the axial direction and operatively coupled to the constrainable means for movement in the substantially perpendicular direction to constrain the constrainable means and to provide for a release of the constraint on the constrainable means upon a release of the cable.

8. In a combination as set forth in claim 7, means operatively coupled to the disc for producing an adjustable frictional force between the disc and the at least one brake liner to obtain the constraint of the constrainable means, and means operatively coupled to the constrainable means for rotation on the axis in a first direction during the constraint of the constrainable means and for rotation on the axis in a second direction opposite to the first direction during the release of the constraint on the constrainable means.

9. In a combination as set forth in claim 6, means extending from the casing for fixedly positioning the casing to provide for the constraint, and the release of the constraint, on the constrainable means.

10. In combination for use in exercise apparatus, constrainable means, first means operatively coupled to the constrainable means for providing a constraint of the constrainable means relative to a particular axis, a member movable with the constrainable means relative to the particular axis during the imposition of the constraint on the constrainable means, second means disposed in a co-operative relationship with the member for imposing a friction force on the member during the movement of the member with the constrainable means relative to the particular axis, third means disposed in a co-operative relationship with the constrainable means for providing a movement of the member with the constrainable means during the constraint of the constrainable means and for releasing the constraint on the constrainable means without providing a movement of the member during such release, and fan blade means operatively coupled to the constrainable means for movement relative to the particular axis during the constraint of the constrainable means and alternately movable in a second direction opposite to the first direction relative to the particular axis during the release of the constraint on the constrainable means to provide a cooling of the member in accordance with such movements of the fan blade means relative to the particular axis.

11. In a combination as set forth in claim 10, the third means including a one way clutch for coupling the member to the first means during the operation of the first means in constraining the constrainable means and for decoupling the member from the constrainable means during the release of the constraint on the constrainable means, the fan blade means being displaced from the member in the direction of the particular axis through a distance to provide for the movement of air along the member in a direction transverse to the axial direction during the rotation of the fan blade means and to facilitate the cooling of the member during the rotation of the fan blade means.

12. In a combination as set forth in claim 10, a casing extending in the direction of the particular axis for holding the first, second and third means and the member and the fan blade means, and means operatively coupled to the casing for providing for a disposition of the casing in a fixed relationship during the constraint of the constrainable means and the release of such constraint on the constrainable means, the casing being vented at the opposite ends of the casing in the direction of the particular axis to co-operate with the fan blade means in cooling the member during the alternate movements of the fan blade means in the first and second opposite directions.

13. In a combination as set forth in claim 10, a casing, the second means being disposed within the casing in coupled relationship to the casing and in frictional relationship to the member, and fourth means disposed in coupled relationship to the casing at a position exterior to the casing for adjusting the frictional force between the member and the second means.

14. In a combination as set forth in claim 13, the fourth means including a dial displaced from the casing and operably coupled to the casing at a position exterior to the casing and rotatable to adjust the friction force imposed by the second means on the member during the movement of the member with the constrainable means, the member being displaced from the constrainable means in the direction of the particular axis to provide a space for the flow of air in accordance with the movement of the fan blade means.

15. In a combination as set forth in claim 14, means associated with the fourth means for providing for an adjustment in the position of the fourth means relative to the member for varying the calibration of the member for individual magnitudes of frictional force in accordance with the wear of the second means.

16. In a combination as set forth in claim 10, means for providing a cooling of the member during the constraint of the constrainable means and during the release of the constraint on the constrainable means, the cooling means including the fan blade means and also including a casing extending in the direction of the particular axis and vented at the opposite ends of the casing in the direction of the particular axis and housing the fan blade means, the constrainable means, the member, the first means, the second means and the third means and co-operating with the fan blade means in cooling the member during the movement of the fan blade means in the first and second opposite directions relative to the particular axis, the fan blade means being displaced from the member in the axial direction through a distance to provide for the movement of air along the member in a direction transverse to the axial direction during the rotation of the fan blade means and to facilitate the cooling of the member during the rotation of the fan blade means.

17. In a combination as set forth in claim 10, the third means including a sleeve having a periphery constructed to provide a substantially uniform winding of the cable on the sleeve periphery and a substantially uniform unwinding of the cable from the sleeve periphery.

18. In combination for use in exercise apparatus, a casing, there being vents in the casing, a member disposed within the casing and rotatable on a particular axis, a friction liner disposed within the casing between the rotatable member and the casing for imposing a frictional force on the rotatable member during the rotation of the member, constrainable means disposed within the casing and constructed to be constrained and released from constraint in accordance with the rotation of the member on the particular axis, first means disposed within the casing and operatively coupled to the constrainable means and the member for constraining the constrainable means and for rotating the member on the particular axis during the constraint of the constrainable means and for releasing the member from the constrainable means during the release of the constraint on the constrainable means, second means disposed within the casing and rotatable on the particular axis for providing for a cooling of the member during the constraint of the constrainable means and the release of the constraint on the constrainable means, the rotatable member being displaced along the particular axis from the constrainable means to provide a spacing between the rotatable member and the constrainable means, and the constrainable means including a helical spring having a plurality of helical turns, and the second means providing for a movement of air alternately in opposite directions through the vents and the space between the successive turns in the helical spring and the space between the member and the helical spring during the constraint, and alternately the release of the constraint, on the helical spring, thereby to cool the member.

19. In a combination as set forth in claim 18, the casing being provided with first and second opposite ends in the direction of the particular axis and with first vents at the first opposite end and with second vents at the second opposite end to enhance the cooling of the rotatable member during the alternate constraint, and the release of constraint, of the constrainable means.

20. In a combination as set forth in claim 19, the second means including a fan blade rotatable on the particular axis during the constraint of the spring and the release of the constraint on the spring and disposed between the rotatable member and the helical spring and displaced from the rotatable member in the direction of the particular axis through a distance to provide for the flow of air through the vents and along the rotatable member during the constraint of the constrainable means and the release of the constraint on the constrainable means to facilitate a cooling of the rotatable member.

21. In a combination as set forth in claim 20, the constrainable means including a cable and a sleeve coupled to the cable and having a periphery constructed to provide a substantially uniform winding of the cable on the sleeve periphery in a plurality of layers and in a plurality of turns in each layer during the release of the constraint on the constrainable means and alternately a substantially uniform unwinding of the cable from the sleeve periphery during the production of the constraint on the constrainable means.

22. In a combination as set forth in claim 18, the second means including fan blades rotatable on the particular axis during the constraint of the spring and the release of the constraint on the spring, the fan blades being displaced from the rotatable member and from the constrainable means in the direction of the particular axis through a distance to enhance the movement of air through the vents and along the rotatable member and in the space, in the direction of the particular axis, between the constrainable means and the rotatable member during the constraint, and the release of the constraint, on the constrainable means.

23. In a combination as set forth in claim 18, third means supported by the casing externally of the casing for providing an adjustment in the frictional force between the member and the friction liner.

24. In a combination as set forth in claim 23, the third means constituting a dial rotatable relative to the casing, fourth means disposed on the casing for indicating the frictional force between the member and the frictional liner for each rotary setting of the dial, and means associated with the dial for adjusting the friction force between the member and the friction liner for any rotary setting of the dial.

25. In combination for use in exercise apparatus, constrainable means, means rotatable on a particular axis, the constrainable means being constrainable on the particular axis, stationary means disposed in co-operative relationship with the rotatable means for producing a friction force on the rotatable means during the rotation of the rotatable means, first means operative during the production of a constraint of the constrainable means on the particular axis for producing a rotary movement of the rotatable means on the particular axis in accordance with such constraint and for preventing any movement of the rotatable means on the particular axis during the release of the constraint on the constrainable means, second means for cooling the rotatable means during the alternate production of the constraint of the constrainable means and the release of the constraint on the constrainable means, a first cable for fixedly positioning the stationary means, a sleeve operatively coupled to the constrainable means for rotation on the particular axis, a second cable operatively coupled to the sleeve for constraining the constrainable means, the sleeve being coupled to the second cable and being constructed at its periphery to receive the cable in a plurality of loops with individual ones of successively wound loops being disposed on successive pairs of previously wound loops in the space between such pairs of the previously wound loops and to provide for a substantially uniform unwinding of the second cable, in the relative disposition of the loops, from the sleeve during the imposition of the constraint on the constrainable means.

26. In combination for use in exercise apparatus, constrainable means, means rotatable on a particular axis, the constrainable means being constrainable on the particular axis, stationary means disposed in co-operative relationship with the rotatable means for producing a friction force on the rotatable means during the rotation of the rotatable means, first means operative during the production of a constraint of the constrainable means on the particular axis for producing a rotary movement of the rotatable means on the particular axis in accordance with such constraint and for preventing any movement of the rotatable means on the particular axis during the release of the constraint on the constrainable means, second means for cooling the rotatable means during the alternate production of the constraint of the constrainable means and the release of the constraint on the constrainable means, a first cable for fixedly positioning the stationary means, a sleeve operatively coupled to the constrainable means for rotation on the particular axis, a second cable operatively coupled to the sleeve for constraining the constrainable means, the sleeve being coupled to the second cable and being constructed to provide for a substantially uniform unwinding of the second cable from the sleeve during the imposition of the constraint on the constrainable means, third means for adjusting the friction force produced between the rotatable means and the stationary means during the rotation of the rotatable means, the sleeve having a periphery bevelled to receive the substantially uniform winding of the second cable on such periphery during the release of the constraint on the constrainable means.

27. In combination for use in exercise apparatus, constrainable means, means rotatable on a particular axis, the constrainable means being constrainable on the particular axis, stationary means disposed in co-operative relationship with the rotatable means for producing a friction force on the rotatable means during the rotation of the rotatable means, first means operative during the production of a constraint of the constrainable means on the particular axis for producing a rotary movement of the rotatable means on the particular axis in accordance with such constraint and for preventing any movement of the rotatable means on the particular axis during the release of the constraint on the constrainable means, second means for cooling the rotatable means during the alternate production of the constraint of the constrainable means and the release of the constraint on the constrainable means, a first cable for fixedly positioning the stationary means, a sleeve operatively coupled to the constrainable means for rotation on the particular axis, a second cable operatively coupled to the sleeve for constraining the constrainable means, the sleeve being coupled to the second cable and being constructed to provide for a substantially uniform unwinding of the second cable from the sleeve during the imposition of the constraint on the constrainable means, a casing for holding the constrainable means, the rotatable means, the stationary means, the first means and the second means, the first cable extending through the casing in a first direction substantially tangential to the periphery of the sleeve, and the second cable extending through the casing in a second direction opposite to the first direction but substantially tangential to the periphery of the sleeve.

28. In a combination as set forth in claim 27, the casing having an annular configuration and extending in the direction of the particular axis, an extension disposed radially outwardly from the annular configuration of the casing at one position, the first cable extending outwardly from the casing through the extension in the first tangential direction and the second cable extending outwardly from the casing through the extension in the second tangential direction.

29. In combination for use in exercise apparatus, constrainable means, the constrainable means being rotatable on a particular axis, means constrainable on the particular axis, stationary means disposed in co-operative relationship with the rotatable means for producing a friction force on the rotatable means during the rotation of the rotatable means, first means operative during the production of a constraint of the constrainable means on the particular axis for producing a rotary movement of the rotatable means on the particular axis in accordance with such constraint and for preventing any movement of the rotatable means on the particular axis during the release of the constraint on the constrainable means, second means for cooling the rotatable means during the alternate production of the constraint of the constrainable means and the release of the constraint on the constrainable means, a first cable for fixedly positioning the stationary means, a sleeve operatively coupled to the constrainable means for rotation on the particular axis, a second cable operatively coupled to the sleeve for constraining the constrainable means, the sleeve being coupled to the second cable and being constructed to provide for a substantially uniform unwinding of the second cable from the sleeve during the imposition of the constraint on the constrainable means, the first means including a one-way clutch for coupling the rotatable means and the constrainable means during the production of the constraint of the constrainable means and for decoupling the constrainable means and the rotatable means during the release of the constraint on the constrainable means, a casing having opposite axial ends in the direction of the particular axis, the casing housing the constrainable means, the rotatable means, the stationary means, the first means, the second means and the sleeve, the casing being vented at its opposite axial ends to facilitate the cooling of the rotatable means during the production of the constraint on the constrainable means and during the release of the constraint on the constrainable means.

30. In combination for use in exercise apparatus, means rotatable on a particular axis, first means disposed relative to the rotatable means for providing a friction force against the rotatable means during the rotation of the rotatable means on the particular axis, means constrainable on the particular axis, second means disposed in coupled relationship to the rotatable means and rotatable on the particular axis for providing a rotation of the rotatable means on the particular axis in accordance with the rotation of the second means, actuating means for providing a force on the second means and a constraint of the constrainable means on the particular axis upon the imposition of a force on the actuating means and for providing for a release of the constraint on the constrainable means on the particular axis upon the release of the force on the actuating means, third means disposed between the constrainable means and the second means for coupling the second means to the constrainable means during the production of the constraint of the constrainable means and for alternately decoupling the second means from the constrainable means upon the release of the constraint on the constrainable means, the actuating means including a sleeve rotatable in a first direction on the particular axis upon the imposition of the force on the actuating means and alternately rotatable in a second direction opposite to the first direction on the particular axis upon the release of the force on the actuating means, and fan blade means operatively coupled to the sleeve for rotation alternately in the first and second directions with the sleeve to provide a cooling action on the rotatable means in accordance with such rotations of the sleeve.

31. In a combination as set forth in claim 30, a casing, the friction means being disposed in the casing in fixed relationship to the casing and abutting the rotatable means in the casing for producing the friction force on the rotatable means during the rotation of the rotatable means during the rotation of the rotatable means in the first direction, and fourth means including the casing and the fan blade means for providing a cooling of the rotatable means during the production of the constraint of the constrainable means and the release of the constraint on the constrainable means, the fourth means including the fan blade means, the fan blade means being disposed in the sleeve in displaced relationship to the rotatable means in the direction of the particular axis through a distance to provide for a movement of air along the rotatable means in accordance with the rotation of the sleeve in the first and second directions on the particular axis and to cool the rotatable means as well as a result of such flow of air.

32. In a combination as set forth in claim 30, a casing extending in the direction of the particular axis, a shaft on which the second and third means are disposed, fourth means disposed externally of the casing in operatively coupled relationship to the shaft for adjusting the force exerted by the friction means against the rotatable means, there being vents in the casing at the opposite axial ends of the casing to provide for a movement between the space outside of the casing and the space inside of the casing of air generated by the rotation of the fan blade means on the particular axis.

33. In a combination as set forth in claim 32, there being intermeshing teeth on the rotatable means and the second means to provide a movement of the rotatable means with the second means, the fan blade means being disposed in displaced relationship to the rotatable means in the direction of the particular axis through a distance to provide for a flow of air along the rotatable means in accordance with the rotation of the fan blade means on the particular axis and to facilitate the flow of air through the casing in accordance with the rotation of the fan blade means on the particular axis.

34. In a combination as set forth in claim 30, a first cable included in the actuating means and coupled to the second means for constraining the constrainable means upon an actuation of the cable in a particular direction, a casing, and a second cable affixed to the casing for holding the casing in a fixed relationship, the first cable extending through the casing for coupling to the actuating means.

35. In a combination as set forth in claim 34, the fan blade means being disposed within the casing and in contiguous relationship to the constrainable means for cooling the rotatable means during the production of the constraint on the constrainable means and the release of the constraint on the constrainable means, a casing extending in the direction of the particular axis, there being vents in the casing at the opposite ends of the casing to co-operate with the fan blade means in cooling the rotatable means during the production of the constraint on the constrainable means and the release of the constraint on the constrainable means.

36. In combination for use in exercise apparatus, constrainable means, a sleeve operatively coupled to the constrainable means and rotatable in a first direction to provide a constraint of the constrainable means and rotatable in a second direction opposite to the first direction to provide a release in the constraint on the constrainable means, a member rotatable with the sleeve during the imposition of the constraint on the constrainable means, first means disposed in co-operative relationship with the member for imposing a friction force on the member during the movement of the member with the constrainable means, a cable operatively coupled to the sleeve, the sleeve having a periphery constructed to provide for a uniform unwinding of the cable from the periphery of the sleeve during the rotation of the sleeve in a direction for imposing the constraint on the constrainable means and to provide for a substantially uniform winding of the cable on the periphery of the sleeve in a plurality of loops with individual ones of the successively wound loops being disposed between successive pairs of the previously wound loops in the space between the successive pairs of the previously wound loops during the rotation of the sleeve in a direction for releasing the constraint on the constrainable means, and second means disposed in co-operative relationship with the sleeve for alternately providing a movement of the member with the sleeve during the imposition of the constraint on the constrainable means and for releasing the constraint on the constrainable means without providing a movement of the member during such release.

37. In a combination as set forth in claim 36, the periphery of the sleeve being bevelled to facilitate the uniform winding of the cable on the periphery of the sleeve in the plurality of layers and in the plurality of turns in each layer during the release of the constraint on the constrainable means and the uniform unwinding of the cable from the periphery of the sleeve during the imposition of the constraint on the constrainable means.

38. In a combination as set forth in claim 36, a casing for holding the sleeve, the rotatable member, the first means, the cable and the second means, the casing having opposite ends in the direction of the particular axis and being vented at its opposite ends to provide for a cooling of the rotatable member.

39. In a combination as set forth in claim 36 for use with a restraining member, a first cable operatively coupled to the sleeve and extending through the casing in a direction substantially tangential to the periphery of the sleeve to provide for a rotation of the sleeve in directions to constrain the constrainable means and release the constraint of the constrainable means, and a second cable operatively coupled to the casing and extending through the casing in a direction opposite to the extension of the first cable through the cable and in a direction substantially tangential to the periphery of the sleeve for coupling to the restraining means.

40. In combination for use in exercise apparatus, constrainable means, a sleeve operatively coupled to the constrainable means and rotatable in a first direction to provide a constraint of the constrainable means and rotatable in a second direction opposite to the first direction to provide a release in the constraint on the constrainable means, a member rotatable with the sleeve during the imposition of the constraint on the constrainable means, first means disposed in co-operative relationship with the member for imposing a friction force on the member during the movement of the member with the constrainable means, a cable operatively coupled to the sleeve, the sleeve having a periphery constructed to provide for a uniform unwinding of the cable from the periphery of the sleeve during the rotation of the sleeve in a direction for imposing the constraint on the constrainable means and to provide for a substantially uniform winding of the cable on the periphery of the sleeve in a plurality of loops with individual ones of the successively wound loops being disposed between successive pairs of the previously wound loops in the space between the successive pairs of the previously wound loops during the rotation of the sleeve in a direction for releasing the constraint on the constrainable means, second means disposed in co-operative relationship with the sleeve for alternately providing a movement of the member with the sleeve during the imposition of the constraint on the constrainable means and for releasing the constraint on the constrainable means without providing a movement of the member during such release, and fan blade means rotatable with the sleeve for cooling the member during the rotation of the fan blade means.

41. In combination for use in exercise apparatus, constrainable means, a sleeve operatively coupled to the constrainable means and rotatable in a first direction to provide a constraint of the constrainable means and rotatable in a second direction opposite to the first direction to provide a release in the constraint on the constrainable means, a member rotatable with the sleeve during the imposition of the constraint on the constrainable means, first means disposed in cooperative relationship with the member for imposing a friction force on the member during the movement of the member with the constrainable means, a cable operatively coupled to the sleeve, the sleeve having a periphery constructed to provide for a uniform unwinding of the cable from the periphery of the sleeve during the rotation of the sleeve in a direction for imposing the constraint on the constrainable means and to provide for a uniform winding of the cable on the periphery of the sleeve during the rotation of the sleeve in a direction for releasing the constraint on the constrainable means, and second means disposed in co-operative relationship with the sleeve for providing a movement of the member with the sleeve during the imposition of the constraint on the constrainable means and for releasing the constraint on the constrainable means without providing a movement of the member during such release, the periphery of the sleeve being bevelled to facilitate the uniform winding of the cable on the periphery of the sleeve during the release of the constraint on the constrainable means and the uniform unwinding of the cable from the periphery of the sleeve during the imposition of the constraint on the constrainable means, fan blade means rotatable with the sleeve for cooling the member during the rotation of the sleeve and the fan blade means in the first and second opposite directions, the fan blade means being disposed within the sleeve in displaced relationship to the constrainable means and in displaced relationship to the member in the direction of the particular axis through a distance for providing a flow of air along the member during the rotation of the fan blade means for cooling the member during the rotation of the fan blade means.

42. In a combination as set forth in claim 41, a casing for holding the sleeve, the rotatable member, the first means, the cable and the second means, the casing having opposite ends in the direction of the particular axis and being vented at its opposite ends to provide for a cooling of the rotatable member in accordance with the rotation of the fan blade means and with the displacement between the fan blade means and the constraining means and the displacement between the fan blade means and the member in the direction of the particular axis.

43. In a combination as set forth in claim 42 for use with a restraining member, a first cable operatively coupled to the sleeve and extending through the casing to provide for a rotation of the sleeve in directions to constrain the constrainable means and release the constraint of the constrainable means, and a second cable operatively coupled to the casing for coupling to the restraining means and extending through the casing, the first and second cables extending from the casing in opposite directions substantially tangential to the periphery of the sleeve.

44. In a combination as set forth in claim 43, the casing having an annular configuration, an extension extending at one position radially outwardly from the annular configuration of the casing, the first cable extending outwardly from the casing through the extension and the second cable extending outwardly from the casing through the extension respectively in the opposite directions substantially tangential to the periphery of the sleeve.

45. In combination for use in exercise apparatus attachable to restraining means, a rotatable disc having a first surface, at least one brake liner having first and second surfaces and having its first surface disposed in frictional relationship to the first surface of the disc, a rotatable sleeve having an annular configuration, constrainable means operatively coupled to the sleeve for imposition of a constraint on the constrainable means, and a release of the constraint on the constrainable means, in accordance with the rotation of the sleeve, a first cable movable in first and second opposite directions and extending into the casing and operatively coupled to the sleeve for rotating the rotatable disc and constraining the constrainable means upon a movement of the cable in the first direction, first means operatively coupled to the sleeve and the disc during the movement of the cable in the first direction for moving the disc in accordance with the movement of the sleeve, and second means for providing a release of the constraint on the constrainable means, without moving the disc, upon the release of the first cable, a casing enveloping the rotatable disc, the brake liner, the constrainable means, the first means and the second means, and the first cable extending into the casing and being attached to the rotatable sleeve, and a second cable operatively coupled to the casing and extending from the casing in a direction to provide for an imposition on the casing of the load imposed by the first cable in producing the rotation of the rotatable disc and the constraint on the constrainable means.

46. In a combination as set forth in claim 45, a centrally disposed shaft, the rotatable disc, the constraining means and the casing being disposed on the shaft, the second cable being operatively coupled to the casing at a position removed from the shaft and extending from the casing in a direction transverse to the shaft.

47. In a combination as set forth in claim 46, third means for cooling the disc during the constraint, and the release of the constraint, of the constrainable means, the third means including vents at the opposite axial ends of the casing.

48. In a combination as set forth in claim 45, the casing having vents at the opposite axial ends of the casing, and means including the vents at the opposite axial ends of the casing for cooling the disc during the constraint and the release of the constraint of the constrainable means.

49. In a combination as set forth in claim 45, third means for adjustably setting the force required to constrain the constrainable means in accordance with the movements of the cable in the first and second opposite directions, the casing having an extension at one end, the first and second cables extending from the extension of the casing in opposite directions substantially tangential to the periphery of the sleeve.

* * * * *